US010023409B2

(12) United States Patent
Aoki et al.

(10) Patent No.: US 10,023,409 B2
(45) Date of Patent: Jul. 17, 2018

(54) PAPER FEEDER AND MEDIUM PROCESSING APPARATUS INCLUDING THE SAME

(71) Applicant: S-PRINTING SOLUTION CO., LTD., Suwon-si, Gyeonggi-do (KR)

(72) Inventors: Eiji Aoki, Suwon-si (KR); Jin-soo Lee, Yongin-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/591,840

(22) Filed: May 10, 2017

(65) Prior Publication Data

US 2017/0327330 A1 Nov. 16, 2017

(30) Foreign Application Priority Data

May 11, 2016 (KR) ..... 10-2016-0057808

(51) Int. Cl.
*B65H 3/48* (2006.01)
*B65H 3/52* (2006.01)

(52) U.S. Cl.
CPC ..... *B65H 3/48* (2013.01); *B65H 3/5261* (2013.01); *B65H 2404/132* (2013.01); *B65H 2406/12* (2013.01); *B65H 2406/15* (2013.01); *B65H 2801/06* (2013.01); *B65H 2801/39* (2013.01)

(58) Field of Classification Search
CPC ..... B65H 3/48; B65H 7/16; B65H 2406/412
See application file for complete search history.

(56) References Cited

U.S. PATENT DOCUMENTS 5,344,133 A * 9/1994 Jantsch ..... B65H 3/128 271/104
6,120,016 A * 9/2000 Watkiss ..... B65H 3/128 271/106
7,690,642 B2 * 4/2010 Roberts ..... B65H 3/48 271/105
8,113,501 B2 * 2/2012 Uji ..... B65H 3/48 271/97
8,419,009 B2 * 4/2013 Yoshii ..... B65H 3/48 271/108
8,857,810 B2 * 10/2014 Yoshii ..... B65H 1/14 271/30.1
2005/0212198 A1 * 9/2005 Dobbertin ..... B65H 3/124 271/198
2017/0052495 A1 2/2017 Eiji et al.

FOREIGN PATENT DOCUMENTS

GB 1303983 A * 1/1973 ..... B65H 3/48
JP 2005-75540 3/2005
KR 10-2017-0022126 3/2017

* cited by examiner

*Primary Examiner* — Patrick Cicchino
(74) *Attorney, Agent, or Firm* — Staas & Halsey LLP

(57) ABSTRACT

A paper feeder includes a load tray where cut-sheet-type media are loaded; a pickup member configured to withdraw the cut-sheet-type media from the load tray; and a blowing unit configured to supply pulse air from a downstream side of the load tray in a loading direction of the cut-sheet-type media to a front end portion of the cut-sheet-type media loaded on the load tray.

19 Claims, 14 Drawing Sheets

PAPER FEEDER AND MEDIUM PROCESSING APPARATUS INCLUDING THE SAME

CROSS-REFERENCE TO RELATED APPLICATION

This application claims the priority benefit of Korean Patent Application No. 10-2016-0057808, filed on May 11, 2016, in the Korean Intellectual Property Office, the disclosure of which is incorporated herein in its entirety by reference.

BACKGROUND

1. Field

The present disclosure relates to paper feeders that separate sheets of a cut-sheet-type medium piece by piece and pulls them out from a load tray and medium processing apparatuses including the paper feeders.

2. Description of the Related Art

Apparatuses such as printers, scanners, and ticketing machines that use a cut-sheet-type medium, for example, cut paper (hereinafter referred to as 'paper'), employ feeders that pull out cut-sheet-type media from a load tray where a plurality of cut-sheet-type media are loaded by separating the cut-sheet-type media piece by piece.

Various pieces of paper may be supplied by feeders. For example, paper may have various basis weight, surface roughness, etc. Paper that has a surface coating layer, tracing paper, perforated paper, etc. have strong adhesion between pieces of paper, and thus, it is difficult to separate the pieces of paper one by one.

Accordingly, a method of weakening the adhesion between pieces of paper loaded on the load tray is needed in order to decrease the possibility of multi-feeding.

SUMMARY

Provided are paper feeders capable of stably feeding a cut-sheet-type medium, and medium processing apparatuses including the paper feeders.

Additional aspects will be set forth in part in the description which follows and, in part, will be apparent from the description, or may be learned by practice of the presented embodiments.

According to an aspect of an embodiment, a paper feeder includes: a load tray where cut-sheet-type media are loaded; a pickup member configured to pick up the cut-sheet-type media from the load tray; and a blowing unit configured to supply pulse air from a downstream side of the load tray in a loading direction of the cut-sheet-type media to a front end portion of the cut-sheet-type media loaded on the load tray.

The paper feeder may further include a separation unit configured to separate, piece by piece, the cut-sheet-type media picked up from the load tray by the pickup member, wherein the blowing unit may be connected to the separation unit to allow the pulse air to be supplied.

The blowing unit may include: a blower; and a pulsation member connected to the separation unit to allow air supplied from the blower to pulsate.

The pulsation member may include: a windmill including one or more wings and connected to the separation unit to rotate; and a guide member configured to guide the air supplied from the blower to the windmill.

The guide member may be configured to form an air chamber and may include an air inlet connected to the blower and an air outlet opened toward the load tray, and the windmill may be located in the air chamber. The one or more wings may be configured to divide the air chamber into two or more sub chambers.

A side wall of the guide member may be open and the guide member may include an air inlet connected to the blower and an air outlet opened toward the load tray, the windmill may include a blocking plate that corresponds to the open side wall of the guide member and is configured to form an air chamber along with the guide member, and the one or more wings may be configured to divide the air chamber into two or more sub chambers.

The separation unit may include: a feed roller configured to rotate in a first direction for transporting the cut-sheet-type media picked up by the pickup member in the loading direction; a retard roller engaged with the feed roller; a driving gear configured to provide a driving force in a second direction for transporting the cut-sheet-type media in an opposite direction to the loading direction to the retard roller; and a torque limiter configured to limit the driving force in the second direction transferred to the retard roller, wherein the windmill may be configured to rotate together with the retard roller.

The retard roller may include a rotation axis, and a roller portion installed at the rotation axis to contact the feed roller, and the windmill may be coupled to one of the rotation axis and the roller portion.

The torque limiter may be configured to connect the driving gear and the rotation axis to each other.

The torque limiter may be configured to connect the rotation axis and the roller portion to each other.

The windmill may be connected to the rotation axis by one or more gears.

The paper feeder may further include: a sensor configured to detect excessive lifting of the front end portion of the sheet-type media.

According to an aspect of another embodiment, a medium processing apparatus includes: the paper feeder; and a medium processor configured to process the cut-sheet-type media supplied from the paper feeder.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
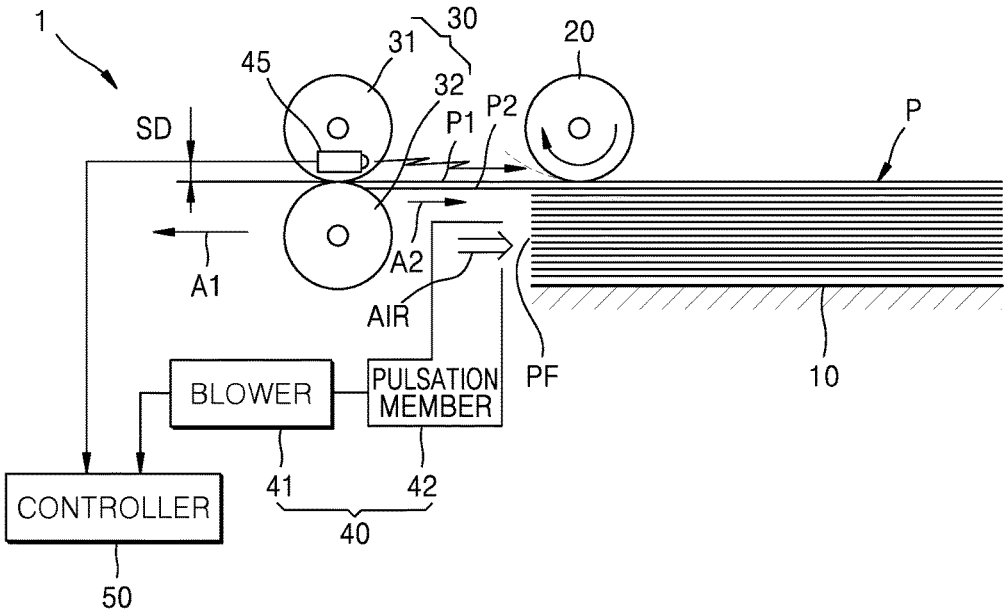
FIG. 1 is a schematic structural diagram of a paper feeder according to an embodiment.

Embodiments of a paper feeder and a medium processing apparatus employing the same will be described hereinafter with reference to the accompanying drawings, wherein like reference numerals refer to like elements throughout, and size or thickness of each element may be exaggerated for clarity of description. In this regard, the present embodiments may have different forms and should not be construed as being limited to the descriptions set forth herein. Accordingly, the embodiments are merely described below, by referring to the figures, to explain aspects. Expressions such as "at least one of," when preceding a list of elements, modify the entire list of elements and do not modify the individual elements of the list.

FIG. 1 is a schematic structural diagram of a paper feeder 1 according to an embodiment. Referring to FIG. 1, the paper feeder 1 includes a load tray 10 where a cut-sheet-type medium (hereinafter referred to as 'paper P'), for example, cut paper, is loaded, and a pickup roller (a pickup member) 20 that withdraws the paper P loaded on the load tray 10 from the load tray 10. The pickup roller 20, for example, contacts paper P1 placed at the top from among pieces of paper P loaded on the load tray 10. The pickup member is not limited to a roller and may be in other various forms such as a belt.

When the pickup roller 20 rotates, the paper P1 is picked up from the load tray 10. In some cases, the paper P1 and one or more pieces of paper P2 under the paper P1 may be picked up together. This case is referred to as multi-feeding.

Multi-feeding occurs when adhesion between the pieces of paper P loaded on the load tray 10 is large. When adhesion between the pieces of paper P loaded on the load tray 10 is large, misfeeding may occur. In this case, the paper P is not picked up even though the pickup roller 20 rotates. In other words, when the papers P stick together, the paper P may not be picked up from the load tray 10.

The paper feeder 1 may further include a separation unit 30 that separates and carries one piece of paper, for example, the paper P1 only, when multi-feeding occurs. The separation unit 30 may have various structures such as a friction separation structure, a reverse separation structure, or the like.

Figure 2:
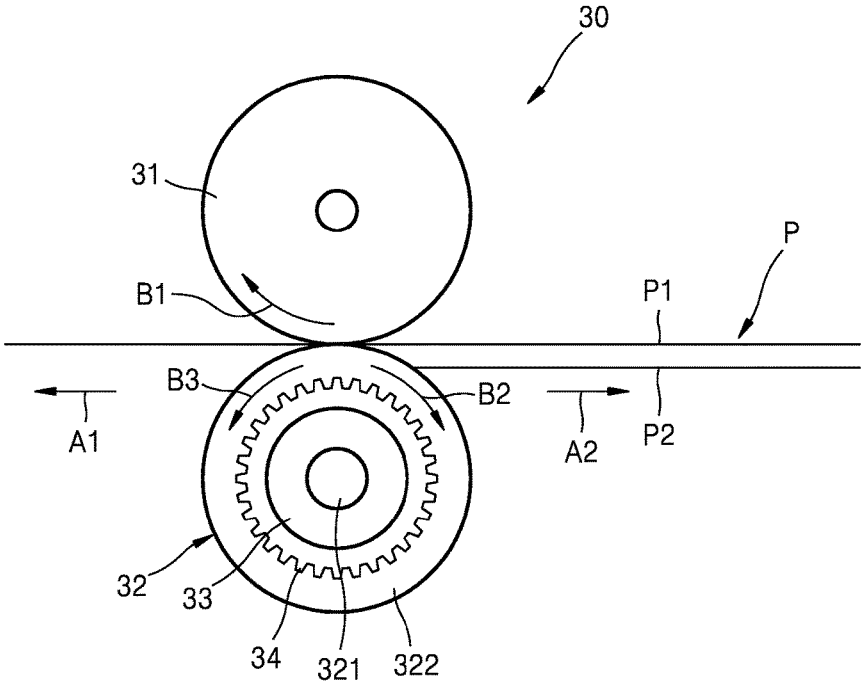
FIG. 2 is a schematic structural diagram of a separation unit having a reverse separation structure, according to an embodiment.

FIG. 2 shows the separation unit 30 with a reverse separation structure, according to an embodiment. Referring to FIG. 2, the separation unit 30 may include a feed roller 31, a retard roller 32, and a torque limiter 33. The feed roller 31 and the retard roller 32 rotate while being engaged with each other. The feed roller 31 rotates in a first direction B1 for transporting the paper P in a loading direction A1. The retard roller 32 rotates in a second direction B2 for transporting the paper P in an inverse direction A2 of the loading direction A1. A driving gear 34 provides a driving force in the second direction B2 to the retard roller 32. The torque limiter 33 limits the driving force in the second direction B2 transferred to the retard roller 32. The torque limiter 33 limits the driving force in the second direction B2 transferred to the retard roller 32 according to a magnitude of load torque applied to the retard roller 32. When a load torque applied to the retard roller 32 is greater than a threshold torque provided by the torque limiter 33, the torque limiter 33 blocks the driving force of the second direction B2 transferred to the retard roller 32. In this case, the retard roller 32 rotates in a third direction B3 due to the feed roller 31.

The torque limiter 33 may have various known structures. For example, the torque limiter 33 may be realized by a spring clutch structure.

The retard roller 32 may include a rotation axis 321, and a roller portion 322 installed at the rotation axis 321 and engaged with the feed roller 31. When the rotation axis 321 and the roller portion 322 are integrally formed with each other or the roller portion 322 is fixed to the rotation axis 321, the rotation axis 321 and the driving gear 34 are connected to each other by the torque limiter 33. For example, a clutch spring (not shown) may be inserted in the rotation axis 321 or a hub fixed to the rotation axis 321, and a predetermined threshold torque may be provided according to a tightening force of the clutch spring. The driving gear 34 provides a driving force in the second direction B2 to the clutch spring. When a load torque applied to the rotation axis 321 is less than a threshold torque, the rotation axis 321 rotates in the second direction B2. When the load torque applied to the rotation axis 321 becomes greater than the threshold torque, the clutch spring extends, thereby blocking a driving force of the driving gear 34.

When the roller portion 322 is rotatably installed at the rotation axis 321, the rotation axis 321 and the roller portion 322 are connected to each other by the torque limiter 33. For example, a clutch spring (not shown) may be inserted in the rotation axis 321 or a hub fixed to the rotation axis 321, and a predetermined threshold torque may be provided according to a tightening force of the clutch spring. An end of the clutch spring may be connected to the roller portion 322. The driving gear 34 is fixed to the rotation axis 321 and rotates the rotation axis 321 in the second direction B2. When a load torque applied to the roller portion 322 is less than a threshold torque, the roller portion 322 rotates in the second direction B2, and when the load torque applied to the roller portion 322 becomes greater than the threshold torque, the clutch spring extends, thereby blocking a driving connection between the rotation axis 321 and the roller portion 322.

A separation operation via the configurations described above will be briefly described below.

When there is no paper P between the feed roller 31 and the retard roller 32, or only one piece of paper P comes between the feed roller 31 and the retard roller 32, a load torque applied to the retard roller 32 is greater than a threshold torque of the torque limiter 33, and thus, a driving force applied to the retard roller 32 is blocked by the torque limiter 33. Accordingly, the retard roller 32 rotates in a third direction B3 for transporting the paper P in the loading direction A1 along with the feed roller 31.

When two or more pieces of paper P, for example, the paper P1 and the paper P2, come between the feed roller 31 and the retard roller 32, the paper P1 and the paper P2 respectively contact the feed roller 31 and the retard roller 32. In this case, a frictional force between the paper P1 and the paper P2 is less than that between the paper P2 and the retard roller 32. Accordingly, slipping occurs between the paper P1 and the paper P2, and a load torque applied to the retard roller 32 is less than a threshold torque provided by the torque limiter 33. The retard roller 32 rotates in the second direction B2, and the paper P2 is transported in the inverse direction A2 of the loading direction A1 by the retard roller 32. Accordingly, only the paper P1 passes between the feed roller 31 and the retard roller 32 and is transported in the loading direction A1.

When the number of pieces of paper P picked up from the load tray 10 by the pickup roller 20 is excessively large, separation performance by the separation unit 30 may be degraded. Therefore, the number of pieces of paper P picked up from the load tray 10 by the pickup roller 20 needs to be reduced as much as possible. In order to improve paper picked up reliability of the paper feeder 1 by decreasing chances of multi-feeding or misfeeding, adhesion may be weakened by separating pieces of paper P loaded on the load tray 10 from each other. The paper feeder 1 according to the present embodiment may include a blowing unit 40 that separates pieces of paper P from each other by supplying air to the pieces of paper P.

A transversal blow structure for supplying air in a transverse direction, that is, a width direction of the paper P perpendicular to the loading direction A1, may also be used. In the transversal blow structure, a blowing unit 40 is installed at one side along the width direction of the paper P. In this case, a blowing unit 40 having a large blowing capacity is used to sufficiently supply air from one side along the width direction of the paper P to the other side. In this case, at the side having a blowing unit 40 installed, the paper P may be lifted excessively, and thus, misfeeding may occur. When a blowing unit 40 is installed at each of one side and the other side along the width direction of the paper P, costs may increase. In addition, although the transversal blow structure may be, for example, used when the paper feeder 1 is mounted in a housing in the form of a box, the transversal blow structure is externally exposed in a paper feeder, such as a multi-purpose tray (MPT) or a document feeder of a scanner, having a structure in which one side portion or both side portions of the load tray 10 in a transverse direction are open. Thus, use of the transversal blow structure is inconvenient.

The blowing unit 40 according to the present embodiment supplies air from a downstream side of a front end portion PF to the front end portion PF with respect to the loading direction A1 of the paper P. A direction of air supplied to the front end portion PF by the blowing unit 40 may be an opposite direction of the loading direction A1. In this regard, the term 'opposite direction' does not specifically refer to the direction A2 only, and refers to a direction from the downstream side of the front end portion PF toward the front end portion PF.

The blowing unit 40 having such a structure may be easily applied to the paper feeder, such as an MPT or a document feeder of a scanner, having a structure in which one side portion or both side portions of the load tray 10 in a transverse direction are open.

When air is supplied to the front end portion PF of the paper P by the blowing unit 40, pieces of paper P loaded on the load tray 10 are lifted and separated from each other, and thus, adhesion between the pieces of paper P may be weakened. The blowing unit 40 according to the present embodiment supplies pulse air. When air pulsates, shock in the form of a pulse is applied to the paper P, and accordingly, the pieces of paper P may be further easily separated from each other.

The blowing unit 40 supplies the pulse air to the front end portion PF of the paper P loaded on the load tray 10.

Although a blower 41 may be intermittently driven in order to supply pulse air, in this case, a driving circuit of the blower 41 may be complicated, and thus, the costs may increase. Although a shutter may be installed in an air path extending from the blower 41 to a front end of the paper P, a means for driving, such as a solenoid, for driving the shutter is required, and thus, the structure may be complicated, and the costs may increase.

The blowing unit 40 is linked with the separation unit 30 to supply pulse air. The blowing unit 40 may include the blower 41 and a pulsation member 42, and the pulsation member 42 may allow air supplied from the blower 41 to pulsate, thereby guiding the air to the front end portion PF of the paper P loaded on the load tray 10. According to the present embodiment, the pulsation member 41 is used to supply pulse air in connection with rotation of the retard roller 32. Thus, pulse air is supplied without intermittently driving the blower 41 or using a shutter and a means for driving the shutter.

Figure 3:
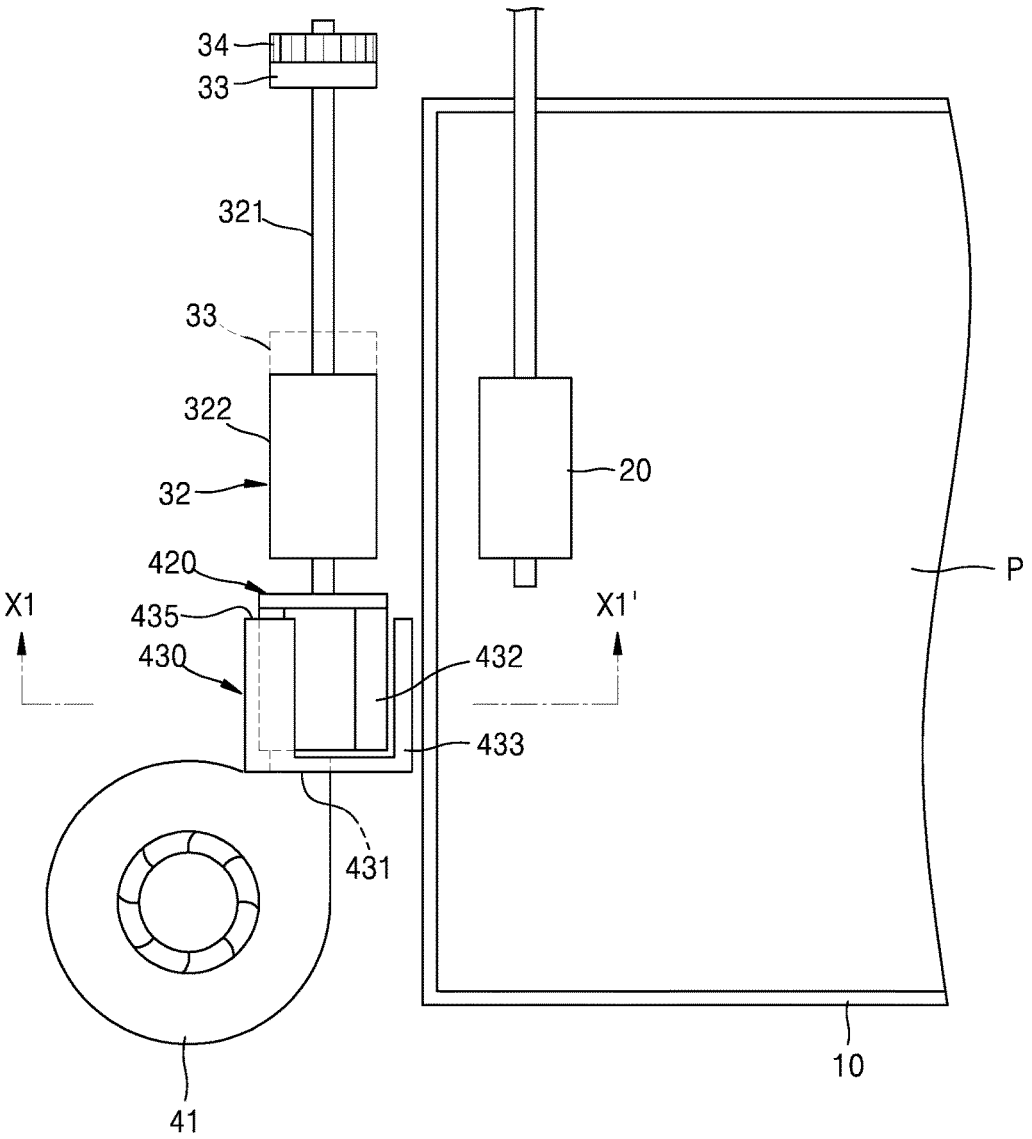
FIG. 3 is a plan view of a paper feeder according to an embodiment.
Figure 4:
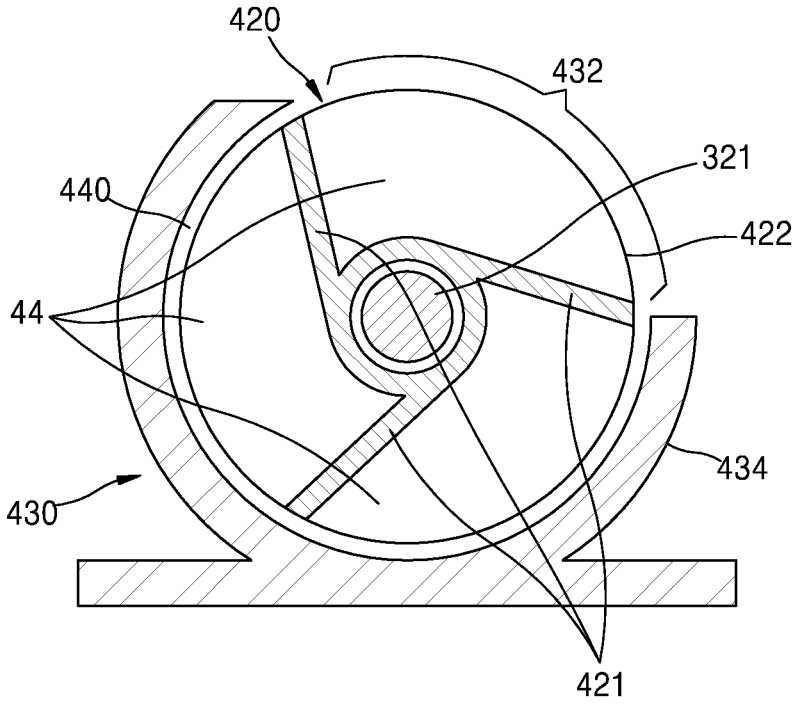
FIG. 4 is a schematic cross-sectional view taken along line X1-X1' of FIG. 3.
Figure 5A:
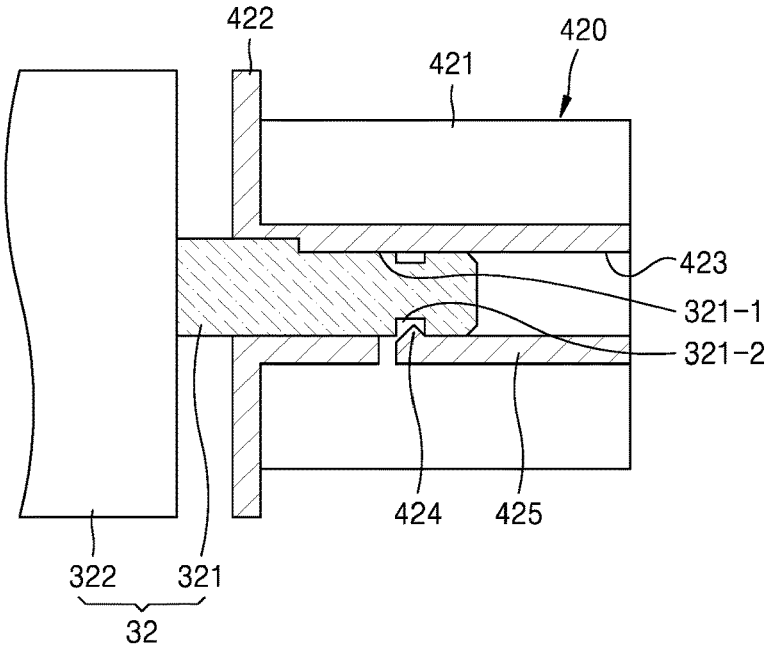
FIG. 5A is a cross-sectional view showing an example of a combination method used in the case of a windmill and a rotation axis.
Figure 5B:
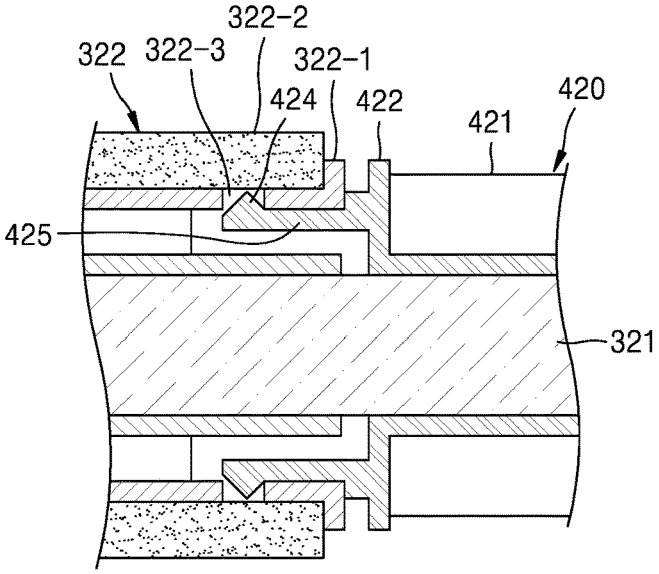
FIG. 5B is a half cross-sectional view showing an example of a combination method used in the case of a windmill and a roller portion.

FIG. 3 is a plan view of the paper feeder 1 according to an embodiment, and FIG. 4 is a schematic cross-sectional view taken along line X1-X1' of FIG. 3. FIGS. 5A and 5B are cross-sectional views showing an example of a combination method used by a windmill 420 and the rotation axis 321. In FIG. 3, the feed roller 31 is omitted.

Referring to FIGS. 3, 4, 5A, and 5B, the pulsation member 42 may include the windmill 420. As illustrated by solid lines in FIG. 3, the torque limiter 33 may connect the driving gear 34 and the rotation axis 321 to each other. Also, as illustrated by dashed lines in FIG. 3, the torque limiter 33 may connect the rotation axis 321 and the roller portion 322 to each other.

The windmill 420 may be coupled to the rotation axis 321 of the retard roller 32 and rotate along with the rotation axis 321. The windmill 420 includes one or more wings 421. The windmill 420 according to the present embodiment includes three wings 421. A diameter of the windmill 420 may be less than that of the retard roller 32, and more particularly, may be less than that of the roller portion 322 so as not to interfere with a pick up of the paper P.

The windmill 420 may be fixed to the rotation axis 321. The windmill 420 may be fixed to the rotation axis 321 by a tight fit method. Also, as shown in FIG. 5A, the windmill 420 may be fixed to the rotation axis 321 by a snap-fit method. For example, the rotation axis 321 may include a D-cut portion 321-1, and the windmill 420 may include a through hole 423 complementary thereto. An elastic arm 425 that includes a hook 424 protruding inwards may be provided on a wall of the through hole 423. The rotation axis 321 may include a groove 321-2. When the windmill 420 is pushed in an axial direction of the rotation axis 321 to insert the D-cut portion 321-1 into the through hole 423, the hook 424 contacts the rotation axis 321, thereby elastically pushing the elastic arm 425 outwards. When the hook 424 reaches the groove 321-2, the elastic arm 425 returns inwards, thereby inserting the hook 424 into the groove 321-2.

As shown in FIG. 5B, the windmill 420 may be fixed to the roller portion 322. Referring to FIG. 5B, the roller portion 322 may include a hub 322-1 inserted into the rotation axis 321, and a rubber portion 322-2 inserted into an outer circumference of the hub 322-1. The windmill 420 may include the elastic arm 425 extending to an inner side of the hub 322-1, and an end portion of the elastic arm 425 may include the hook 424 protruding outwards. The hub 322-1 includes a groove 322-3 which the hook 424 is coupled to. Accordingly, the windmill 420 may rotate along with the roller portion 322.

Although not shown, the windmill 420 may be integrally formed with the roller portion 322. For example, the windmill 420 may be integrally formed with the hub 322-1.

A guide member 430 guides air supplied from the blower 41 to the windmill 420. The guide member 430 may form an air chamber 440, and the windmill 420 may be installed in the air chamber 440.

The guide member 430 may form the air chamber 440 by surrounding the windmill 420. The guide member 430 includes an air inlet 431 and an air outlet 432. In the present embodiment, the blower 41 axially supplies air to the windmill 420. Accordingly, the air inlet 431 is provided on one side wall 433 of the guide member 430 in a direction of the rotation axis 321. The air outlet 432 is provided on a side wall 434 near the load tray 10.

For assembly convenience of the retard roller 32 which the windmill 420 is coupled to, an opposite side wall 435 of the air inlet 431 of the guide member 430 may be open. A blocking plate 422 extending in a diameter direction may be provided on one side of the windmill 420 in a direction of the rotation axis 321. The blocking plate 422 may form the air chamber 440 along with the guide member 430. The wing 421 may divide the air chamber 440 formed by the guide member 430 and the blocking plate 422 into two or more. According to the present embodiment, the air chamber 440 is divided into three sub chambers 44 by the three wings 421.

Figure 6:
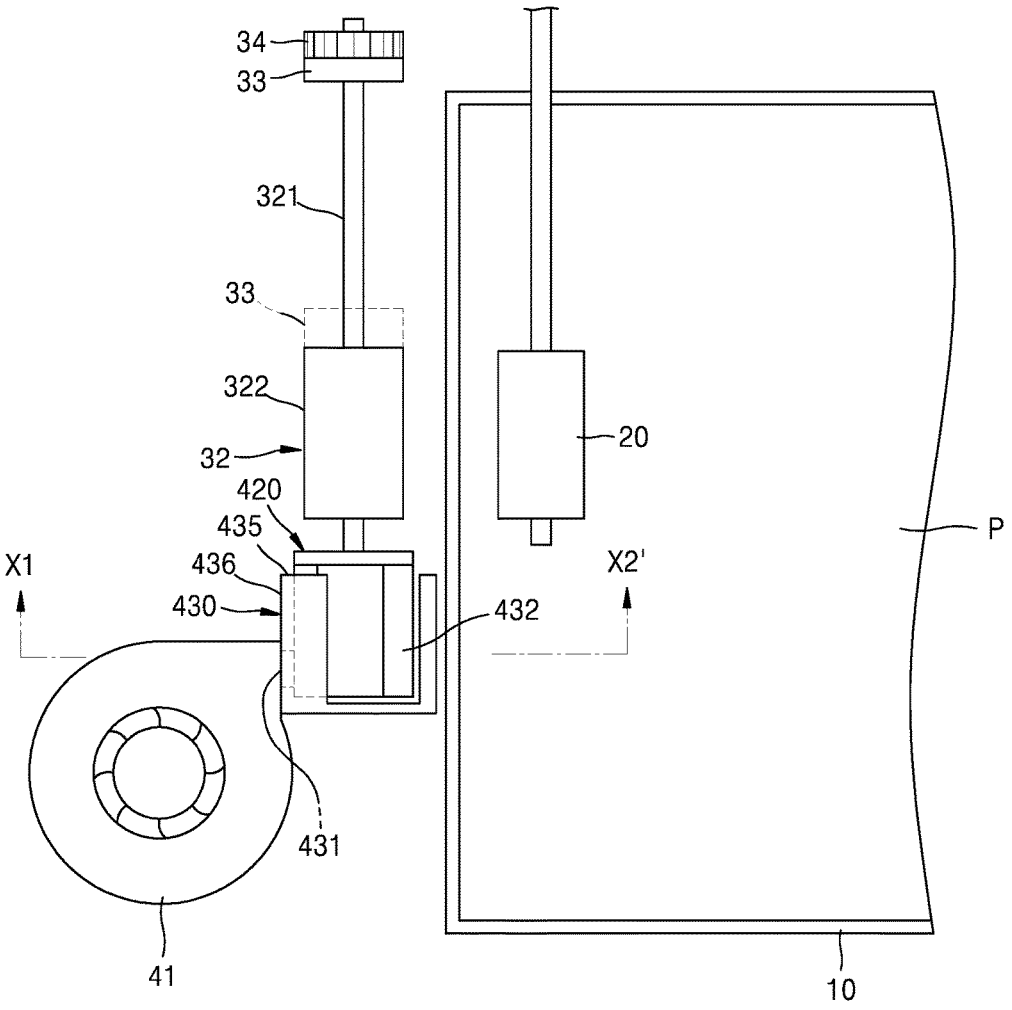
FIG. 6 is a plan view of a paper feeder according to an embodiment.
Figure 7:
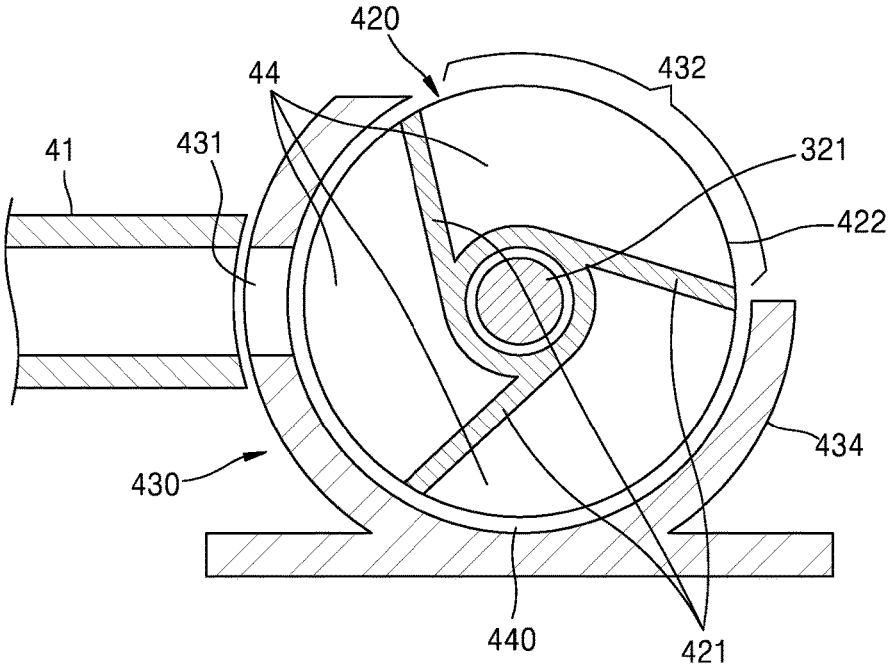
FIG. 7 is a schematic cross-sectional view taken along line X2-X2' of FIG. 6.

FIG. 6 is a plan view of the paper feeder 1 according to an embodiment, and FIG. 7 is a schematic cross-sectional view taken along line X2-X2' of FIG. 6. In FIG. 6, the feed roller 31 is omitted. The paper feeder 1 according to the present embodiment differs from the paper feeder 1 shown in FIGS. 3 and 4 in that the blower 41 transversely supplies air to the guide member 430.

Referring to FIGS. 6 and 7, since the blower 41 transversely supplies air to the windmill 420, the air inlet 431 is provided on one side wall 436 of the guide member 430 in a transverse direction. The air outlet 432 is provided on the side wall 434 near the load tray 10. For assembly convenience of the retard roller 32 coupled to the windmill 420, one side wall 435 of the guide member 430 in a direction of the rotation axis 321 may be open. The blocking plate 422 extending in a diameter direction and forming the air chamber 440 along with the guide member 430 may be provided on one side of the windmill 420 in a direction of the rotation axis 321.

In the embodiments shown in FIGS. 3 to 7, the windmill 420 includes the three wings 421. However, the windmill 420 may include only one wing 421. In this case, the wing 421 may extend in a diameter direction of the windmill 420, and thus, two sub chambers 44 may be formed. In some embodiments, two, four, or more wings 421 may be used.

Due to the configurations described above, the windmill 420 may rotate along with the retard roller 32. Air supplied by the blower 41 flows into the air chamber 440 via the air inlet 431. The air is compressed in sub chambers 44 that do not face the air outlet 432 from among the sub chambers 44. As the windmill 420 rotates, the sub chambers 44 sequentially face the air outlet 432, and the compressed air is supplied to the front end portion PF of the paper P loaded on the load tray 10 via the air outlet 432. Since air compressed in the sub chambers 44 is sequentially discharged via the air outlet 432, pulse air may be supplied to the front end portion PF of the paper P loaded on the load tray 10. As described above, the paper feeder 1 may supply pulse air due to use of the pulsation member 42.

Figure 8:
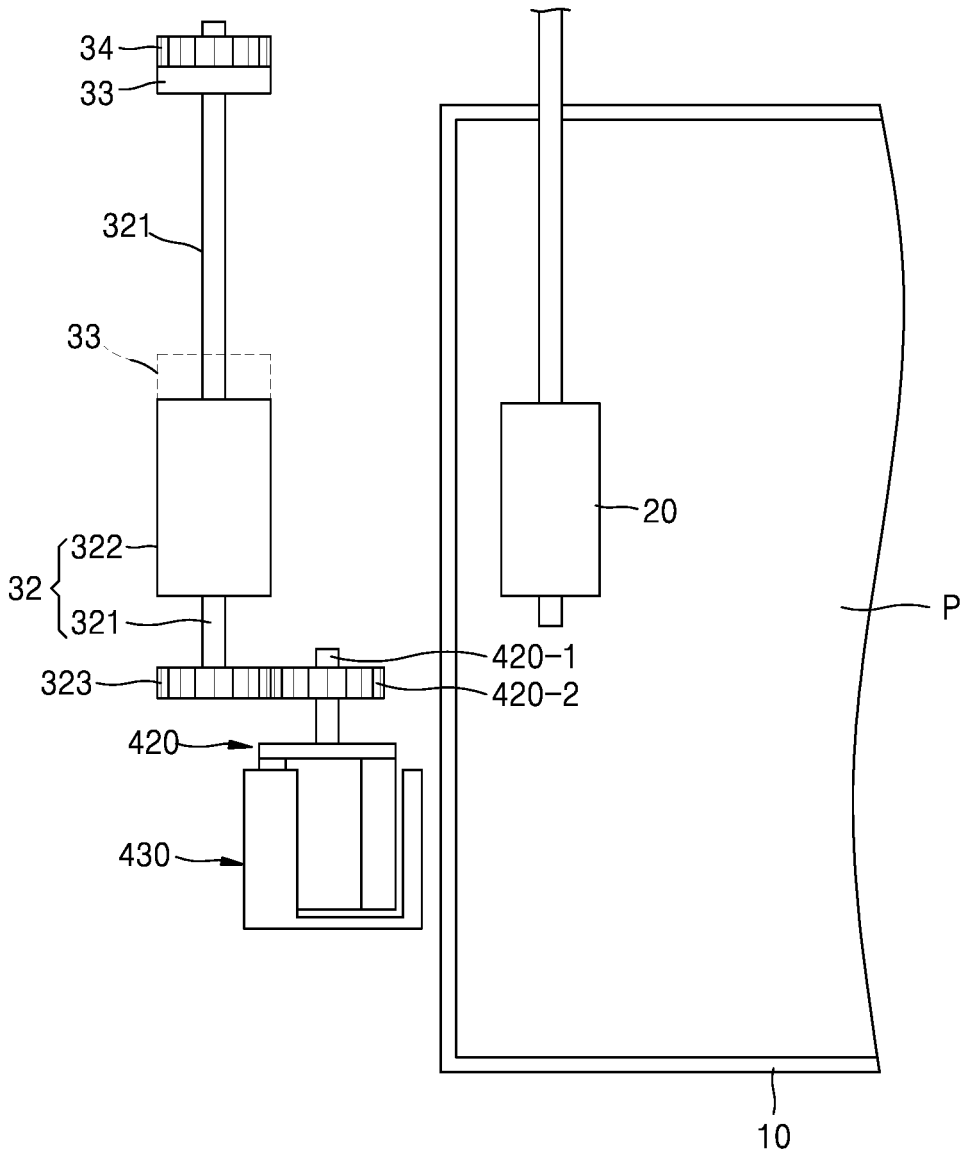
FIG. 8 is a plan view of a paper feeder according to an embodiment.

In the previous embodiment, the windmill 420 rotates along with the retard roller 32 as the windmill 420 is installed at the rotation axis 321 of the retard roller 32. However, a structure for rotating the windmill 420 is not limited thereto. FIG. 8 is a plan view of the paper feeder 1 according to an embodiment. In FIG. 8, the feed roller 31 and the blower 41 are omitted. Referring to FIG. 8, the windmill 420 is rotatably installed at a rotation axis 420-1. A first gear 323 is installed at the rotation axis 321 of the retard roller 32, and a second gear 420-2 engaged with the first gear 323 is installed at the rotation axis 420-1. Accordingly, the windmill 420 may rotate along with the retard roller 32. In some embodiments, one or more gears (not shown) may be disposed between the first and second gears 323 and 420-2 to set a rotation speed and a rotation direction.

Referring to FIG. 1 again, the paper feeder 1 may further include a sensor 45 for detecting paper being lifted. The sensor 45 detects how much the paper P loaded on the load tray 10 is lifted by the blowing unit 40. When the paper P is excessively lifted, the paper P picked up from the load tray 10 by the pickup roller 20 crashes into the feed roller 31 and thus may not come between the feed roller 31 and the retard roller 32, and a paper jam may occur. The sensor 45 detects the paper P being excessively lifted. For example, the sensor 45 may be located in a location spaced apart by a predetermined distance in a loading direction of the paper P from the paper P1 placed at the top from among pieces of paper P loaded on the load tray 10 and may emit light toward the load tray 10, and may receive light reflected from one or more pieces of paper P lifted by air supplied from the blowing unit 40, thereby detecting whether the paper P is excessively lifted. A separation distance SD of the sensor 45 from the paper P1 may be determined by taking into account a distance between the pickup roller 20 and the separation unit 30, a diameter of the feed roller 31, and the like.

A controller 50 determines, based on a detection signal of the sensor 45, whether the paper P is excessively lifted. The controller 50 checks whether paper is excessively lifted before starting to withdraw paper and after starting to withdraw paper.

For example, after driving the blower 41 to rotate at a reference rotation speed, the controller 50 checks whether the paper P is excessively lifted before starting to drive the pickup roller 20. For example, the controller 50 may check whether the paper P is excessively lifted from the sensor 45 after T msec lapses since starting to drive the blower 41. When the paper P is excessively lifted, adhesion between pieces of paper P loaded on the load tray 10 is rather alleviated by initial rotation of the blower 41, and accordingly, the controller 50 starts to drive the pickup roller 20 after decreasing a rotation speed of the blower 41. The rotation speed of the blower 41 may be about half the reference rotation speed. In addition, the controller 50 may start to drive the pickup roller 20 after turning off the blower 41. After the pickup roller 20 starts to be driven, the controller 50 checks again whether one or more pieces of paper P picked up from the load tray 10 by the pickup roller 20 are excessively lifted. When the paper P is excessively lifted, the controller 50 decreases a rotation speed of the blower 41. The rotation speed of the blower 41 may be about half a reference rotation speed. The controller 50 may change the rotation speed of the ventilator 41 to the reference rotation speed before starting to withdraw next paper P. Also, the controller 50 may turn off the blower 41, and may turn on the blower 41 before starting to withdraw next paper.

Figure 9:
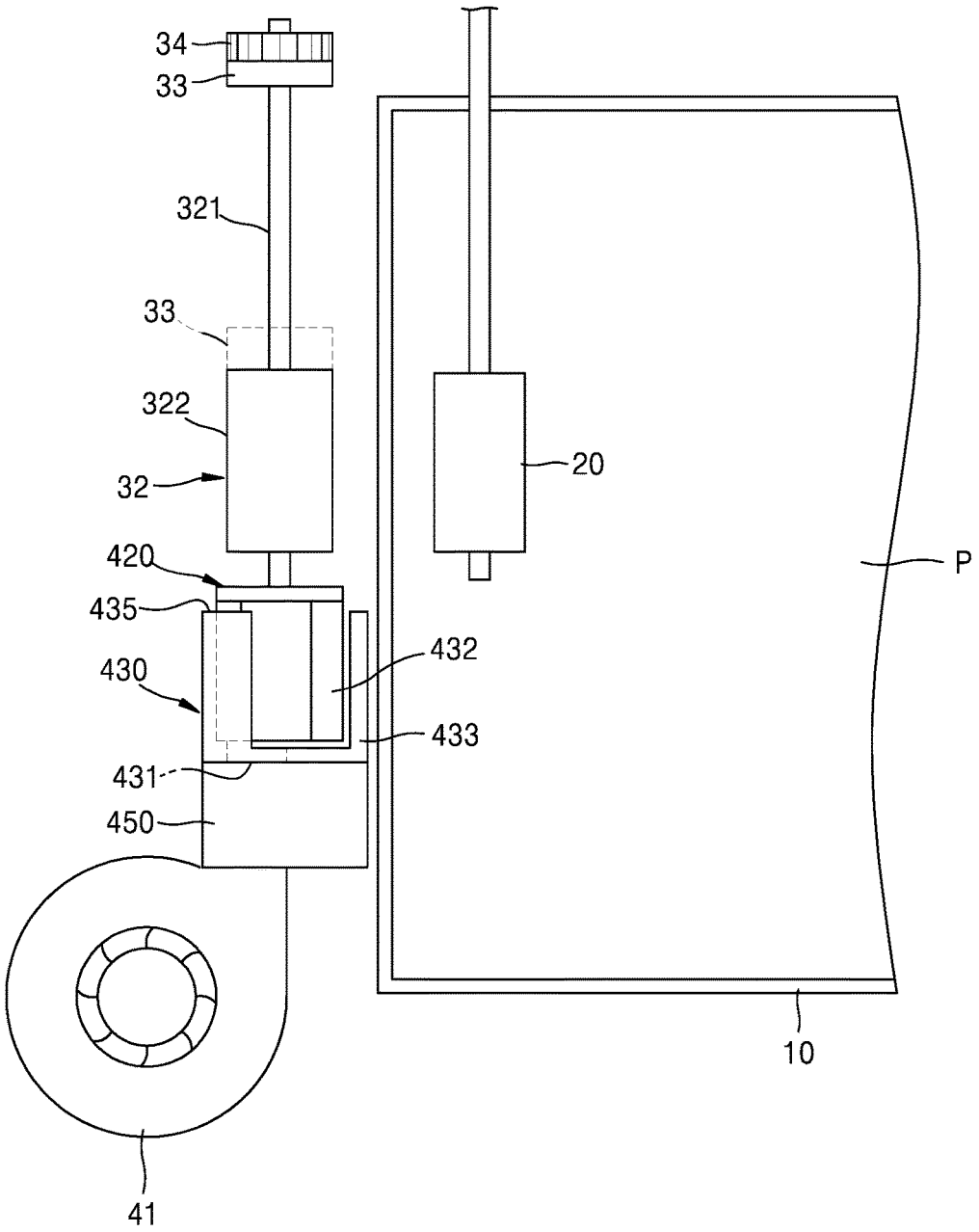
FIG. 9 is a plan view of a paper feeder according to an embodiment.

FIG. 9 is a plan view of the paper feeder 1 according to an embodiment. In FIG. 9, the feed roller 31 is omitted. Referring to FIG. 9, the paper feeder 1 according to the present embodiment is the same as the paper feeder 1 shown in FIG. 3 except that a compression chamber 450 is disposed between the blower 41 and the guide member 430. Air supplied from the blower 41 passes through the compression chamber 450 and is supplied to the inside of the guide member 430 via the air inlet 431.

Figure 10:
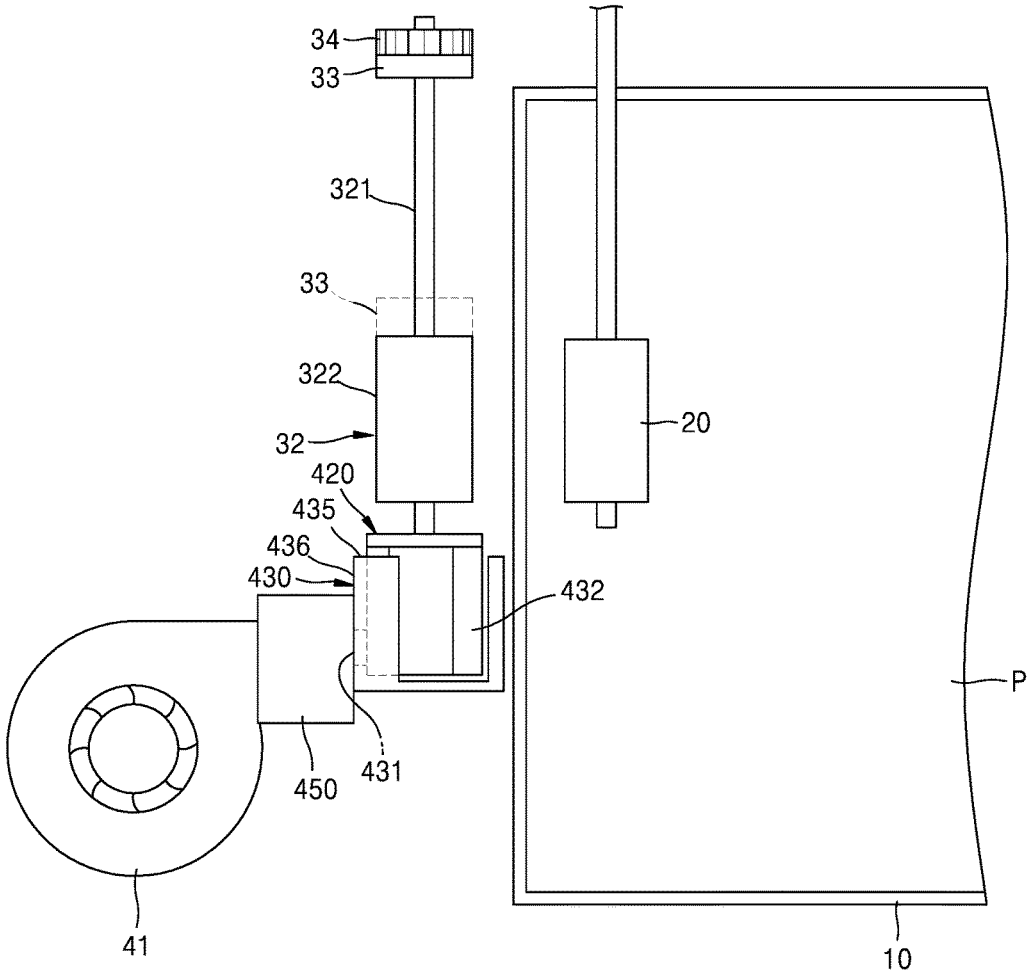
FIG. 10 is a plan view of a paper feeder according to an embodiment.

FIG. 10 is a plan view of the paper feeder 1 according to an embodiment. In FIG. 10, the feed roller 31 is omitted. Referring to FIG. 10, the paper feeder 1 according to the present embodiment is the same as the paper feeder 1 shown in FIG. 6 except that the compression chamber 450 is disposed between the blower 41 and the guide member 430. Air supplied from the blower 41 passes through the compression chamber 450 and is supplied to the inside of the guide member 430 via the air inlet 431.

By the configurations described above, when the blower 41 starts to be driven earlier than the separation unit 30, air is compressed in the compression chamber 450 and the air chamber 440, and when the windmill 420 starts to rotate as the separation unit 30 starts to be driven, the compressed air may be supplied with strong pressure to the front end portion PF of the paper P, and thus, adhesion between pieces of paper P may be effectively weakened.

Figure 11:
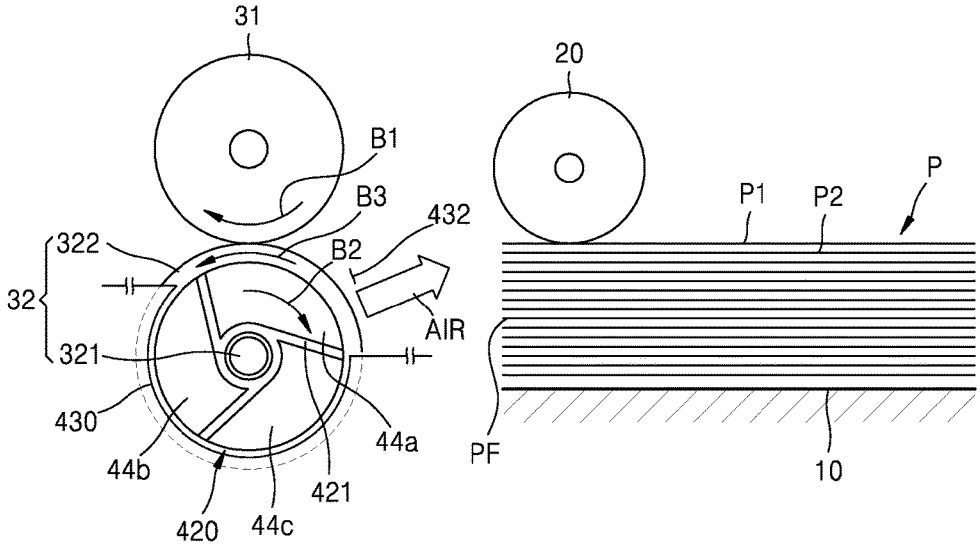
FIG. 11 is a diagram of a paper feeder after starting to drive a separation unit and a ventilator and before starting to drive a pickup roller.
Figure 12:
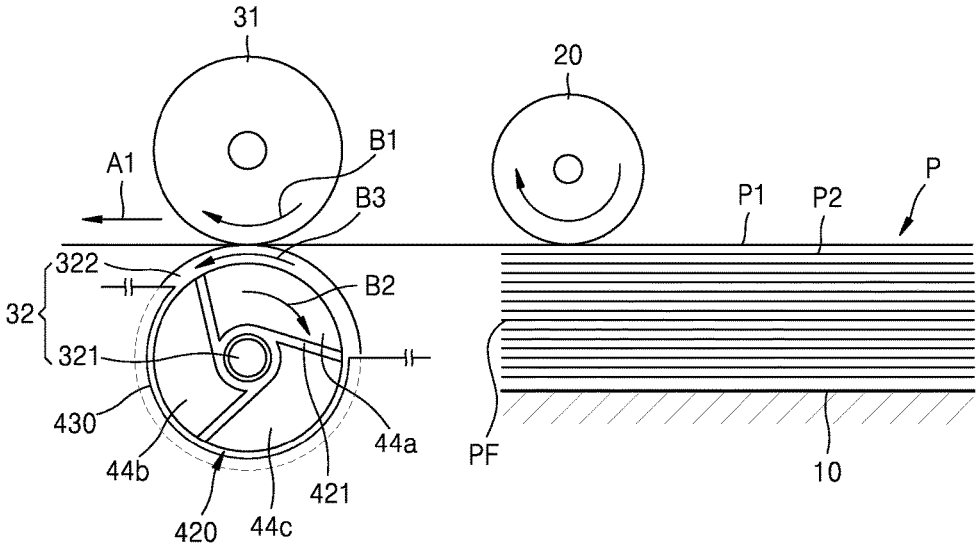
FIG. 12 is a diagram of a paper feeder, showing a state wherein a piece of paper placed at the top of a load tray is picked up from the load tray.
Figure 13:
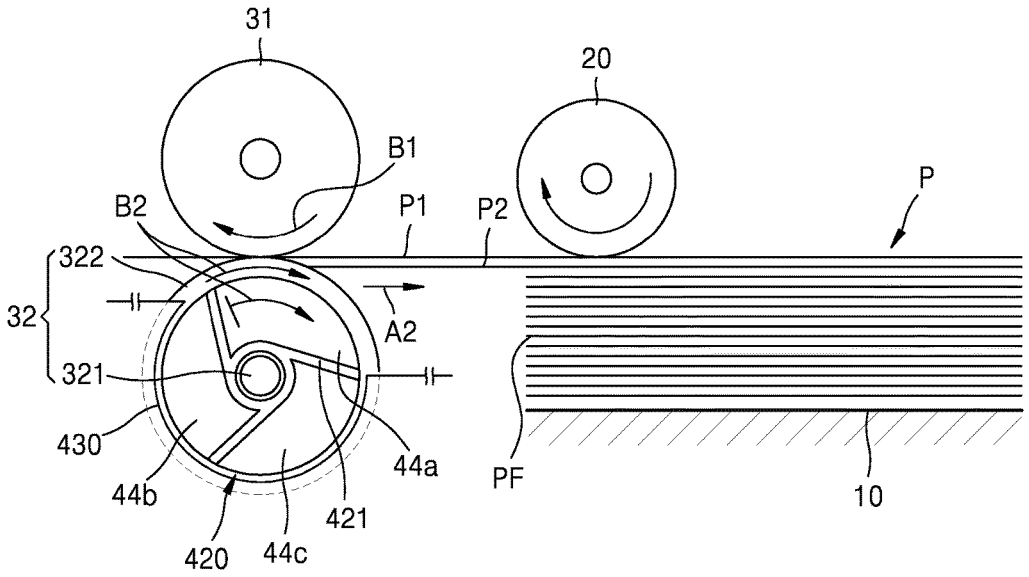
FIG. 13 is a diagram of a paper feeder, showing a state wherein two pieces of paper are picked up from a load tray.

FIG. 11 is a diagram of the paper feeder 1 after starting to drive the separation unit 30 and the blower 41 and before starting to drive the pickup roller 20. FIG. 12 is a diagram of the paper feeder 1 having the paper P1 placed at the top picked up from the load tray 10. FIG. 13 is a diagram of the paper feeder 1 having the two pieces of paper P1 and P2 picked up from the load tray 10. In FIGS. 11 to 13, the guide member 430 is briefly shown, and the blower 41 is omitted. A paper pick up operation of the paper feeder 1 according to the previous embodiments will now be described with reference to FIGS. 11 to 13.

First, a paper pick up operation in a structure where the torque limiter 33 connects the rotation axis 321 and the roller portion 322 to each other and the windmill 420 is fixed to the rotation axis 321 will be described.

In this case, the rotation axis 321 rotates in the second direction B2 all the time due to the driving gear 34, and the windmill 420 also rotates in the second direction B2 all the time. The roller portion 322 rotates in the second direction B2 or the third direction B3, depending on whether there is paper P between the feed roller 31 and the roller portion 322 and how many pieces of paper P there are therebetween.

The separation unit 30 and the blower 41 start to be driven. The separation unit 30 and the blower 41 may start to be driven simultaneously, or either one of the separation unit 30 and the blower 41 may start to be driven earlier. In the present embodiment, the separation unit 30 starts to be driven after the blower 41 starts to be driven. The blower 41 is driven at a reference rotation speed.

When the compression chamber 450 is provided, the blower 41 is driven and air is compressed in the compression chamber 450 and the air chamber 440 while the separation unit 30 is not driven. After T msec lapses since the blower 41 starts to be driven, whether the paper P is excessively lifted is determined based on a detection signal of the sensor 45. When excessive lifting of the paper P is detected, a rotation speed of the blower 41 may be decreased so as to be lower than the reference rotation speed, and the blower 41 may be turned off.

Referring to FIG. 11, when the separation unit 30 and the blower 41 start to be driven, the rotation axis 321 rotates in the second direction B2. Since the roller portion 322 contacts the feed roller 31, a load torque applied to the roller portion 322 is greater than a threshold torque of the torque limiter 33. Accordingly, the roller portion 322 rotates in the third direction B3 along the feed roller 31. The windmill 420 rotates in the second direction B2 along with the rotation axis 321.

The blower 41 supplies air to sub chambers 44*a*, 44*b*, and 44*c*. The sub chamber 44*a* is connected to the air outlet 432, and accordingly, air supplied to the sub chamber 44*a* is supplied to the front end portion PF of the paper P via the air outlet 432. Air is supplied to flow between pieces of paper P, and the pieces of paper P are lifted with respect to each other. Thus, adhesion between the pieces of paper P weakens.

As the windmill 420 rotates in the second direction B2, the sub chamber 44*b* and the sub chamber 44*c* sequentially face the air outlet 432, and air is supplied toward the front end portion PF. Air supplied to the sub chambers 44*b* and 44*c* may be compressed in the sub chambers 44*b* and 44*c* while the sub chambers 44*b* and 44*c* do not face the air outlet 432. As described above, as the sub chambers 44*a*, 44*b*, and 44*c* sequentially face the air outlet 432, pulse air is supplied to the front end portion PF of pieces of paper P loaded on the load tray 10, and thus, the pieces of paper P vibrate, thereby further weakening the adhesion between the pieces of paper P. In a structure where the air chamber 440 is not formed, that is, in a structure where the guide member 430 merely guides air supplied from the blower 41 to the windmill 420, air supplied to the sub chambers 44*b* and 44*c* may not be compressed.

Referring to FIG. 12, the pickup roller 20 starts to be driven. Only the paper P1 contacting the pickup roller 20 may be picked up from the load tray 10 by the pickup roller 20. In this regard, when excessive lifting of the paper P is detected by the sensor 45, a rotation speed of the ventilator 41 may be decreased.

Since a load torque applied to the roller portion 322 is greater than a threshold torque of the torque limiter 33 even in a state where the paper P1 is between the feed roller 31 and the roller portion 322, the roller portion 322 rotates in the third direction B3 along the feed roller 31. Accordingly, the paper P1 is transported in the loading direction A1.

The windmill 420 rotates in the second direction B2 with the rotation axis 321. Accordingly, air is compressed in the sub chambers 44*a*, 44*b*, and 44*c* and is sequentially supplied in the form of pulsation to the front end portion PF via the air outlet 432. In this regard, since the air is blocked by the paper P1 fed by the feed roller 31 and the retard roller 32, the air is not dispersed and further strongly acts upon the front end portion PF. Accordingly, a possibility that the paper P2 under the paper P1 is picked up following the paper P1 during a pick up of the paper P1 may be decreased.

Several pieces of paper P may be picked up from the load tray 10 by the pickup roller 20. That is, multi-feeding may occur. Referring to FIG. 13, several pieces of paper P, for example, the paper P1 and the paper P2, may be picked up from the load tray 10 and come between the feed roller 31 and the roller portion 322. Thus, slipping may occur between the paper P1 and the paper P2 in an area where the feed roller 31 and the roller portion 322 contact each other, and a load torque applied to the roller portion 322 becomes less than a threshold torque of the torque limiter 33. Thus, the roller portion 322 rotates in the second direction B2 along with the rotation axis 321, and the paper P2 is transported in the inverse direction A2 of the loading direction A1 by the roller portion 322. Accordingly, only the upper paper P1 is separated from the pieces of paper P and transported in the loading direction A1. Even in this case, air is blocked by the paper P2 fed by the retard roller 32 in the inverse direction A2, and accordingly, the air is not dispersed and further strongly acts upon the front end portion PF, and a possibility that the paper P under the paper P2 is picked up after the paper P2 may be decreased.

Next, a paper pick up operation in a structure where the torque limiter 33 connects the driving gear 34 and the rotation axis 321 to each other and the windmill 420 is fixed to the rotation axis 321 will be described.

In this case, the rotation axis 321 and the roller portion 322 rotate together in the same direction, and the windmill 420 also rotates in the same direction as the rotation axis 321. When there is no paper P between the feed roller 31 and the roller portion 322 or there is only one piece of paper P therebetween as shown in FIGS. 11 and 12, a load torque applied to the retard roller 32 is greater than a threshold torque of the torque limiter 33, and accordingly, a power connection between the driving gear 34 and the rotation axis 321 is blocked. Thus, the retard roller 32 rotates in the third direction B3 due to the feed roller 31, and the windmill 420 also rotates in the third direction B3. When there are two or more pieces of paper P between the feed roller 31 and the roller portion 322 as shown in FIG. 13, a load torque applied to the retard roller 32 is less than a threshold torque of the torque limiter 33, and accordingly, the power connection between the driving gear 34 and the rotation axis 321 is maintained. Thus, the retard roller 32 rotates in the second direction B2 due to the driving gear 34, and the windmill 420 also rotates in the second direction B2.

A paper pick up operation in the case where the torque limiter 33 connects the rotation axis 321 and the roller portion 322 to each other and the windmill 420 is fixed to the roller portion 322 or is integrally formed with the roller portion 322 and in the case where the torque limiter 33 connects the driving gear 34 and the rotation axis 321 to each other and the windmill 420 is fixed to the roller portion 322 or is integrally formed with the roller portion 322 is the same as the paper pick up operation in the structure where the torque limiter 33 connects the driving gear 34 and the rotation axis 321 to each other and the windmill 420 is fixed to the rotation axis 321.

As shown in FIG. 8, when the windmill 420 is connected to the rotation axis 321 by a gear structure, the windmill 420 rotates in an opposite direction to the rotation axis 321, and a resulting paper pick up operation is the same as described above except a rotation direction of the windmill 420.

Figure 14:
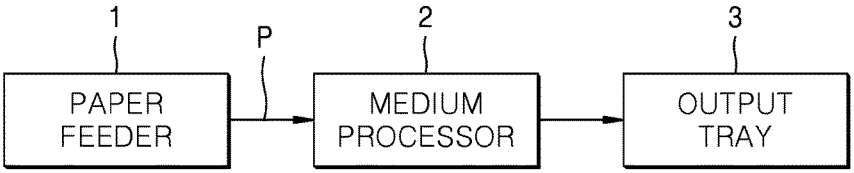
FIG. 14 is a block diagram of a medium processing apparatus including a paper feeder, according to an embodiment.

The paper feeder 1 described above may be applied to various apparatuses. FIG. 14 is a block diagram of a medium processing apparatus including the paper feeder 1, according to an embodiment. Referring to FIG. 14, the medium processing apparatus includes the paper feeder 1, and a medium processor 2 that receives the paper P from the paper feeder 1 and processes the paper P. The processed paper P may be discharged to an output tray 3.

Figure 15:
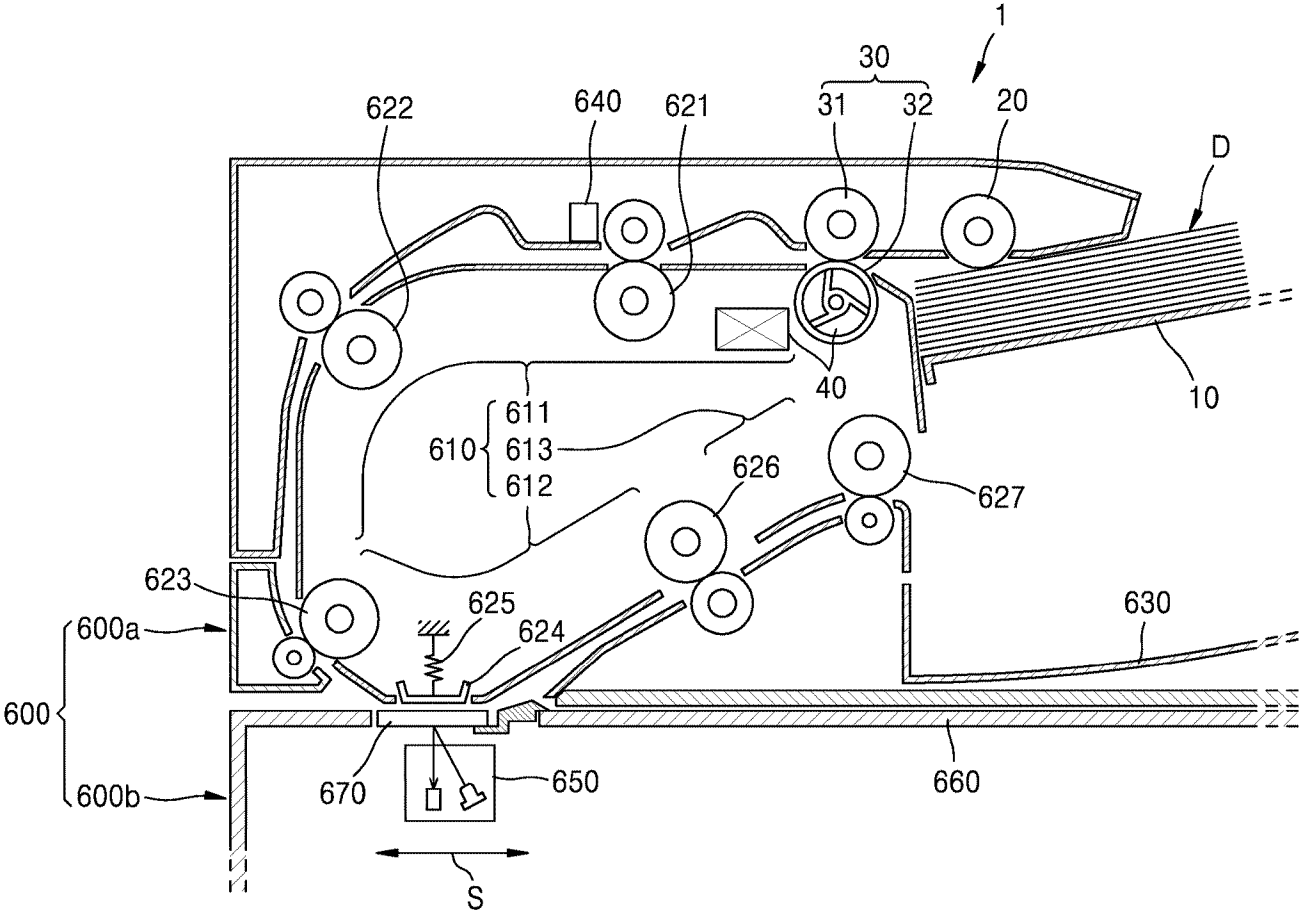
FIG. 15 is a schematic structural diagram of a scanner including a paper feeder, according to an embodiment.

FIG. 15 is a schematic structural diagram of a scanner 600 including the paper feeder 1, according to an embodiment. Referring to FIG. 15, the scanner 600 includes the paper feeder 1 and a medium processor that reads an image while transporting a document D supplied from the paper feeder 1. The medium processor may include a document feeding unit 600*a* and a reading unit 600*b* that reads an image from a document. The paper feeder 1 has been described with reference to FIGS. 1 to 13. Since the scanner 600 is an apparatus that reads an image recorded on the document D, the paper feeder 1 transports the document D.

The reading unit 600*b* includes a reading member 650 for reading an image from the document D. The reading member 650 emits light toward the document D, receives light reflected from the document D, and reads an image of the document D. As the reading member 650, a contact type image sensor (CIS), a charge coupled device (CCD), or the like may be used.

The scanner 600 uses a flatbed method in which the document D is located at a fixed location and a reading member such as a CIS or a CCD reads an image while moving, a document feeding method in which a reading member is located at a fixed location and the document D is transported, or a combination thereof. The scanner 600 according to the present embodiment is a scanner that uses a combination of the flatbed method and the document feeding method.

The reading unit 600*b* includes a platen glass 660 on which the document D is placed to read an image from the document D by using the flatbed method. Also, the reading unit 600*b* includes a reading window 670 for reading an image from the document D by using the document feeding method. The reading window 670 may be, for example, a transparent member. In an embodiment, an upper surface of the reading window 670 may have the same height as an upper surface of the platen glass 660.

When the document feeding method is used, the reading member 650 is located below the reading window 670. When the flatbed method is used, the reading member 650 may be moved in a sub-scanning direction S, that is, in a length direction of the document D, below the platen glass 660 by a means of transport that is not shown. Also, when the flatbed method is used, the platen glass 660 may be externally exposed in order to place the document D on the platen glass 660. For this, the document feeding unit 600*a* may rotate with respect to the reading unit 600*b* to expose the platen glass 660.

The document feeding unit 600*a* transports the document D so that the reading member 650 may read an image recorded on the document D, and discharges the read document D. For this, the document feeding unit 600*a* includes a document feeding path 610, and the reading member 650 reads an image from the document D transported along the document feeding path 610. The document feeding path 610 may include, for example, a supply path 611, a reading path 612, and a discharge path 613. The reading member 650 is disposed in the reading path 612, and an image recorded on the document D is read by the reading member 650 while passing through the reading path 612. The supply path 611 is a path for supplying the document D to the reading path 612, and the document D loaded on the load tray 10 is supplied to the reading path 612 via the supply path 611. The discharge path 613 is a path for discharging the document D having passed through the reading path 612. Accordingly, the document D loaded on the load tray 10 is transported along the supply path 611, the reading path 612, and the discharge path 613 and is discharged to the discharge tray 630.

Transport rollers 621 and 622 for transporting the document D picked up from the load tray 10 by the paper feeder 1 may be disposed in the document feeding path 610. Each of the transport rollers 621 and 622 may have a structure in which a driving roller and a driven roller rotate while being engaged with each other.

Transport rollers 623 and 626 for transporting the document D may be disposed in the reading path 612. For example, the transport rollers 623 and 626 for transporting the document D may be disposed at both sides of the reading member 650. Each of the transport rollers 623 and 626 may have a structure in which a driving roller and a driven roller rotate while being engaged with each other. A reading guide member 624 facing the reading member 650 is disposed in the reading path 612. The reading guide member 624 is pressed against the reading window 670 by self-weight or an elastic member 625, and the document D is transported to come between the reading window 670 and the reading guide member 624. Although not shown, a reading roller that is elastically pressed against the reading window 670 and rotates to transport the document D supplied therebetween may be used instead of the reading guide member 624.

A discharge roller 627 that discharges the document D that has been read is disposed in the discharge path 613. The discharge roller 627 may have a structure in which a driving roller and a driven roller rotate while being engaged with each other.

By the configurations described above, the document D supplied from the paper feeder 1 is transported along the supply path 611, the reading path 612, and the discharge path 613, and the reading member 650 may read an image from the document D.

Figure 16:
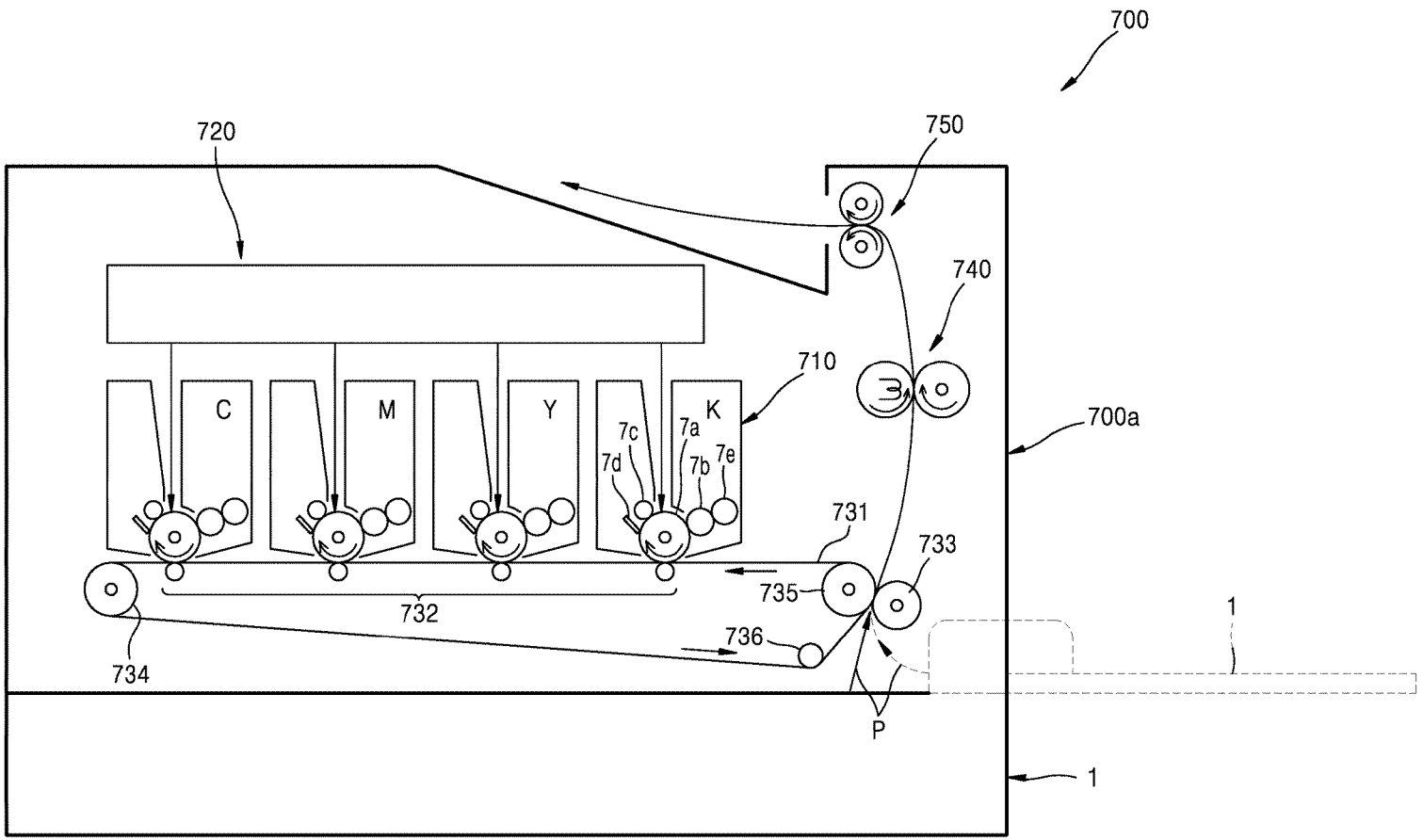
FIG. 16 is a schematic structural diagram of an image forming apparatus including a paper feeder, according to an embodiment.

FIG. 16 is a schematic structural diagram of an image forming apparatus 700 including the paper feeder 1, according to an embodiment. Referring to FIG. 16, the image forming apparatus 700 includes the paper feeder 1, and a printing unit (medium processor) 700*a* that prints an image on the paper P supplied from the paper feeder 1. As shown by solid lines in FIG. 16, the paper feeder 1 may be in the form of a cassette feeder and be located under the printing unit 700*a*. Also, as shown by dashed lines in FIG. 16, the paper feeder 1 may be realized in the form of an MPT located at one side portion of the printing unit 700*a*.

The printing unit 700*a* according to the present embodiment may print an image on the paper P by using various methods such as an electro photography method, an inkjet method, a thermal transfer method, or a thermal sublimation method. The image forming apparatus according to the present embodiment prints a color image on the paper P by using the electro photography method. Referring to FIG. 16, the printing unit 700*a* may include a plurality of developing devices 710, an exposure device 720, a transfer device, and a fusing device 740.

For color printing, the plurality of developing devices 710 may include, for example, four developing devices 710 for developing images of cyan C, magenta M, yellow Y, and black K. The four developing devices 710 may accommodate toner of cyan C, magenta M, yellow Y, and black K, respectively. The printing unit 700*a* may further include a developing device 710 for accommodating toner of various color, such as light magenta, white, etc., in addition to the color described above, and developing an image of such color.

The developing device 710 includes a photosensitive drum 7*a*. The photosensitive drum 7*a* is an example of a photoreceptor having an electrostatic latent image formed on a surface thereof, and may include a conductive metal pipe and a photosensitive layer formed on the outer circumference thereof. A charging roller 7*c* is an example of a charger that charges the photosensitive drum 7*a* to have a uniform surface potential. A cleaning blade 7*d* is an example of a cleaning means that removes toner and a foreign material remaining on a surface of the photosensitive drum 7*a* after a transfer process that will be described later.

The developing device 710 supplies toner accommodated therein to an electrostatic latent image formed on the photosensitive drum 7*a* and thus develops the electrostatic latent image into a visible toner image. Examples of developing methods include a one-component developing method using toner and a two-component developing method using toner and carrier. The developing device 710 according to the present embodiment uses the one-component developing method. A developing roller 7*b* is used to supply toner to the photosensitive drum 7*a*. A developing bias voltage for supplying toner to the photosensitive drum 7*a* may be applied to the developing roller 7*b*.

The one-component developing method may be classified into a contact developing method in which the developing roller 7*b* and the photosensitive drum 7*a* rotate in contact with each other and a non-contact developing method in which the developing roller 7*b* and the photosensitive drum 7*a* rotate spaced apart from each other by about tens to hundreds of microns. A supply roller 7*e* supplies toner in the developing device 710 to a surface of the developing roller 7*b*. A supply bias voltage for supplying toner in the developing device 710 to a surface of the developing roller 7*b* may be applied to the supply roller 7*e*.

The exposure device 720 forms an electrostatic latent image on the photosensitive drum 7*a* by irradiating light modulated according to image information on the photosensitive drum 7*a*. As the exposure device 720, a laser scanning unit (LSU) using laser diode as a light source, a light-emitting diode (LED) exposure device using an LED as a light source, or the like may be used.

The transfer device may include an intermediate transfer belt 731, a first transfer roller 732, and a second transfer roller 733. A toner image developed on photosensitive drums 7*a* of the four developing devices 710 is temporarily transferred to the intermediate transfer belt 731. The intermediate transfer belt 731 is circulated while being supported by supporting rollers 734, 735, and 736. Four first transfer rollers 732 are disposed at locations facing the photosensitive drums 7*a* of the four developing devices 710 with the intermediate transfer belt 731 therebetween. A first transfer bias voltage for first transferring a toner image developed on the photosensitive drum 7*a* to the intermediate transfer belt 731 is applied to the four first transfer rollers 732. The second transfer roller 733 faces the intermediate transfer belt 731. A second transfer bias voltage for transferring the toner image first transferred to the intermediate transfer belt 731 to the paper P is applied to the second transfer roller 733.

Upon receiving a printing command from a host (not shown), a controller (not shown) charges a surface of the photosensitive drum 7*a* to a uniform potential via the charging roller 7*c*. The exposure device 720 forms an electrostatic latent image on the photosensitive drum 7*a* by scanning four light beams modulated according to image information of each color to the photosensitive drums 7*a* of the four developing devices 710. The developing roller 7*b* develops the electrostatic latent image into a visible toner image by supplying C, M, Y, K toner to corresponding photosensitive drums 7*a*, respectively. Developed toner images are firstly transferred to the intermediate transfer belt 731. The paper P is transported from the paper feeder 1 to a transfer nip formed by the second transfer roller 733 and the intermediate transfer belt 731. The toner images firstly transferred on the intermediate transfer belt 731 are secondly transferred to the paper P by the second transfer bias voltage applied to the second transfer roller 733. When the paper P passes through the fusing device 740, the toner images are fused to the paper P by heat and pressure. The paper P on which fusing has been performed is externally discharged by the discharge roller 750.

Figure 17:
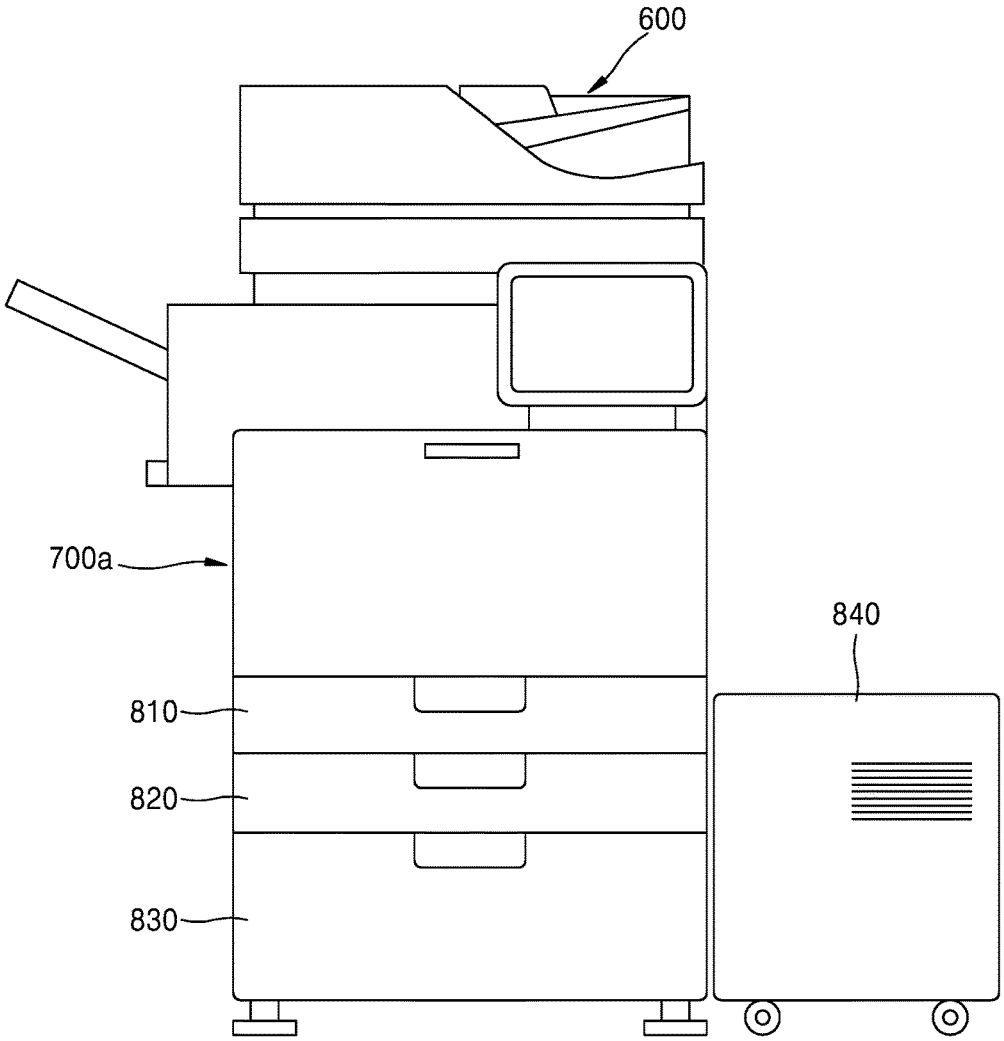
FIG. 17 is a schematic diagram of a multifunctional apparatus according to an embodiment.

The scanner 600 and the image forming apparatus 700 may each be used separately or may be combined with each other to be used in the form of a multifunctional apparatus. FIG. 17 is a schematic diagram of an all-in-one device according to an embodiment.

Referring to FIG. 17, the scanner 600 is disposed on the printing unit 700*a*. Structures of the scanner 600 and the printing unit 700*a* are the same as those shown in FIGS. 15 and 16. The paper feeder 1 that supplies the paper P to the printing unit 700*a* may be realized in various forms. For example, the paper feeder 1 shown in FIGS. 1 to 11 may be used in the form of a MPT located at a side portion of the printing unit 700*a* as shown in FIG. 16, a main cassette feeder 810 installed under the printing unit 700*a*, a secondary cassette feeder 820 installed under the main cassette feeder 810, a high capacity feeder 830 installed below the main cassette feeder 810 or under the secondary cassette feeder 820, a high capacity feeder 840 installed at a side portion of the printing unit 700*a*, or the like.

It should be understood that the embodiments described herein should be considered in a descriptive sense only and not for purposes of limitation. Descriptions of the features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A paper feeder comprising:

a load tray where cut-sheet-type media are loadable to be transported toward a downstream side out of the load tray in a transporting direction;

a pickup member to pick up the cut-sheet-type media from the load tray;

a separation unit to separate a cut-sheet-type medium from the picked up cut-sheet-type media, by rotatably contacting the cut-sheet-type medium while the separated cut-sheet type medium is transported toward the downstream side out of the load tray in the transporting direction; and a blowing unit coupled to the separation unit to be driven by the separation unit, to supply pulse air from the downstream side of the load tray toward the load tray in an inverse direction of the transporting direction, and to a front end portion of the cut-sheet-type media with respect to the transporting direction.

2. The paper feeder of claim 1, wherein the blowing unit comprises:

a blower to supply air; and a pulsation member connected to the separation unit to control the air supplied from the blower to pulsate, to supply the pulse air.

3. The paper feeder of claim 2, wherein the pulsation member comprises:

a windmill comprising at least one wing and connected to the separation unit to rotate; and a guide member to guide the air supplied from the blower to the windmill.

4. The paper feeder of claim 3, wherein the guide member comprises:

an air chamber, an air inlet connected to the blower, and an air outlet opened toward the load tray, wherein the windmill is located in the air chamber.

5. The paper feeder of claim 4, wherein the at least one wing is to divide the air chamber into a plurality of sub chambers.

6. The paper feeder of claim 3, wherein at least one portion of a side wall of the guide member is open, the guide member comprises an air inlet connected to the blower and an air outlet opened toward the load tray, the windmill comprises a blocking plate that corresponds to the at least one portion of the side wall of the guide member being open and is to form an air chamber along with the guide member, and the at least one wing is to divide the air chamber into a plurality of sub chambers.

7. The paper feeder of claim 3, wherein the separation unit comprises:

a feed roller to rotate in a first direction to transport the cut-sheet-type media picked up by the pickup member in the transporting direction;

a retard roller to be engaged with the feed roller;

a driving gear to provide a driving force to the retard roller in a second direction, to move the contacted cut-sheet-type medium in the inverse direction of the transporting direction; and a torque limiter to limit the driving force in the second direction transferred to the retard roller, wherein the windmill is to rotate together with the retard roller.

8. The paper feeder of claim 7, wherein the retard roller comprises a rotation axis, and a roller portion coupled to the rotation axis to contact the feed roller, and the windmill is coupled to the rotation axis or the roller portion.

9. The paper feeder of claim 8, wherein the torque limiter is to connect the driving gear and the rotation axis.

10. The paper feeder of claim 8, wherein the torque limiter is to connect the rotation axis and the roller portion.

11. The paper feeder of claim 8, wherein the windmill is connected to the rotation axis by at least one gear.

12. The paper feeder of claim 1, further comprising:

a sensor to detect excessive lifting of the front end portion of the cut-sheet-type media.

13. A medium processing apparatus comprising:

a paper feeder to supply cut-sheet-type media, comprising:

a load tray where the cut-sheet-type media are loadable to be transported toward a downstream side out of the load tray in a transporting direction;

a pickup member to pick up the cut-sheet-type media from the load tray;

a separation unit to separate a cut-sheet-type medium from the picked up cut-sheet-type media, by rotatably contacting the cut-sheet-type medium while the separated cut-sheet type medium is transported toward the downstream side out of the load tray in the transporting direction; and a blowing unit coupled to the separation unit to be driven by the separation unit, to supply pulse air from a downstream side of the load tray toward the load tray in an inverse direction of the transporting direction, and to a front end portion of the cut-sheet-type media with respect to the transporting direction; and a medium processor to process a supplied cut-sheet-type medium supplied from the paper feeder, among the picked-up cut-sheet-type media.

14. The medium processing apparatus of claim 13, wherein the blowing unit comprises a blower, a windmill comprising at least one wing and connected to the separation unit to rotate, and a guide member to guide air supplied from the blower to the windmill.

15. The medium processing apparatus of claim 14, wherein the guide member is to form an air chamber and comprises an air inlet connected to the blower and an air outlet opened toward the load tray, and the windmill is located in the air chamber.

16. The medium processing apparatus of claim 14, wherein at least one portion of a side wall of the guide member is open, the guide member comprises an air inlet connected to the ventilator and an air outlet opened toward the load tray, the windmill comprises a blocking plate that corresponds to the at least one portion of the side wall of the guide member being open and is to form an air chamber along with the guide member, and the at least one wing is to divide the air chamber into a plurality of sub chambers.

17. The medium processing apparatus of claim 14, wherein the separation unit comprises:

a feed roller to rotate in a first direction to transport the sheet-type media picked up by the pickup member in the transporting direction;

a retard roller to be engaged with the feed roller;

a driving gear to provide a driving force to the retard roller in a second direction, to move the contacted cut-sheet-type medium in the inverse direction of the transporting direction; and a torque limiter to limit the driving force in the second direction transferred to the retard roller, wherein the windmill is to rotate together with the retard roller.

18. The medium processing apparatus of claim 13, further comprising:

a sensor to detect excessive lifting of the front end portion of the cut-sheet-type media.

19. The medium processing apparatus of claim 13, wherein the medium processor comprises at least one of a reading unit to read images from the cut-sheet-type media and/or a printing unit to print images on the cut-sheet-type media.

* * * * *